US005449555A

United States Patent [19]

Karstens et al.

[11] Patent Number: 5,449,555

[45] Date of Patent: Sep. 12, 1995

[54] CELLULOSE ACETATE FILAMENTS, AN OPTICALLY ISOTROPIC SPINNING SOLUTION THEREFOR, AND USE THEREOF FOR THE PRODUCTION OF FILAMENTS

[75] Inventors: Ties Karstens, Bötzingen; Wolfgang Koppe, Freiburg; Joachim Schätzle, Herbolzheim; Günter Maurer, Neuenburg, all of Germany

[73] Assignee: Rhone-Poulenc Rhodia Aktiengesellschaft, Freiburg, Germany

[21] Appl. No.: 185,596

[22] Filed: Jan. 21, 1994

[30] Foreign Application Priority Data

Jan. 26, 1993 [DE] Germany ..... 43 02 055.0

[51] Int. Cl.[6] ..... D02G 3/00

[52] U.S. Cl. ..... 428/364; 428/393; 536/69; 536/76

[58] Field of Search ..... 428/364, 393; 536/69, 536/76; 264/187, 200; 131/345

[56] References Cited

U.S. PATENT DOCUMENTS

| | | | |
|---|---|---|---|
| 2,065,518 | 12/1936 | Dreyfus et al. | 264/200 |
| 2,632,686 | 3/1953 | Bashford et al. | 264/200 |
| 2,806,474 | 8/1957 | Yarsley | 264/200 |
| 3,670,069 | 6/1972 | Mitchell et al. | 264/187 |
| 3,839,527 | 10/1974 | Turbak et al. | 264/200 |
| 3,961,007 | 6/1976 | Caputi et al. | 264/200 |
| 4,415,734 | 11/1983 | Yabune et al. | 536/76 |
| 4,543,406 | 8/1985 | Diamantoglou | 428/364 |
| 4,543,409 | 9/1985 | Diamantoglou et al. | 536/68 |
| 4,582,899 | 4/1986 | Nakamura | 536/76 |
| 4,983,730 | 1/1991 | Domeshek et al. | 536/69 |
| 5,269,996 | 12/1993 | Lee | 264/207 |

FOREIGN PATENT DOCUMENTS 2718768 11/1978 Germany .

*Primary Examiner*—N. Edwards
*Attorney, Agent, or Firm*—Bucknam and Archer

[57] ABSTRACT

There are described filaments on the basis of a cellulose acetate soluble in acetone, the degree of polymerization (DP) of the cellulose acetate being between about 110 and 210 and the degree of substitution (DS) preferably between about 2.2 and 2.7. Optically isotropic spinning solutions can be obtained, the cellulose acetate concentration of which is about 35 to 47 mass-%. When such an optically isotropic spinning solution is spun, in particular by dry spinning, filaments are obtained in a profitable manner because the costs connected with the recovery of the acetone can be appreciably lowered, without impairing the desirable properties of the filaments, which are suitable in particular for the production of cigarette filter tow.

5 Claims, No Drawings

CELLULOSE ACETATE FILAMENTS, AN OPTICALLY ISOTROPIC SPINNING SOLUTION THEREFOR, AND USE THEREOF FOR THE PRODUCTION OF FILAMENTS

FIELD OF THE INVENTION

The present invention relates to filaments based on an acetone-soluble cellulose acetate, an optically isotropic spinning solution for the production of filaments which contains a cellulose acetate dissolved in acetone and possibly other additives, as well as the application of this spinning solution for the production of these filaments.

BACKGROUND OF THE INVENTION

DE-OS 27 05 382 describes a large group of cellulose derivatives, including cellulose acetates. These are to be converted into an anisotropic spinning solution in order to produce filaments by conventional spinning processes. According to Table 1, the degree of substitution (DS) of the cellulose acetate must be between 1.89 and 2.45. As suitable solvents for the solution are indicated predominantly halogenized and phenolic compounds. In connection with the additional cellulose derivatives indicated in DE-OS 27 05 382, also acetone is listed among a large number of solvents. The cellulose derivatives must be present in the spinning solution in an amount of at least 15 vol.%, to meet the requirement of optical anisotropism. However, in DE-OS 27 05 382 the combination "cellulose acetate dissolved in acetone" is not mentioned. Further, a 15-vol, % acetone solution of the cellulose acetate described in DE-OS 27 05 382 would not be optically anisotropic, but would be optically isotropic.

A cellulose acetate of 1.89 degree of substitution (DS) is not soluble in acetone. This is evident from Houben-Weyl "Methoden der orgnischen Chemie" Vol. E 20, Part 3, "Macromolecular Substances", Georg Thieme Verlag Stuttgart, N.Y., 1987, p.2099. According to the DE-OS 27 05 382, cellulose derivatives with a mean degree of polymerization (DP) Of at least 100 anhydroglucose units are said to have a sufficiently high molecular weight to be suitable for the production of filaments. Precise statements concerning the degree of polymerization of cellulose acetate of DS 1.89–2.45 are not stated in DE-OS 27 05 382. This is discussed in Ullmann's Encyclopedia of Industrial Chemistry, 5th fully revised edition, Vol. A5, pp 447–448 in connection with the spinning of "secondary acetate" dissolved in acetone. By this is to be understood "cellulose-2.5-acetate". The number "2.5" means the average number of acetyl groups per anhydroglucose unit. For the production of fibers and cigarette filter tow there is stipulated for the cellulose-2.5-acetate a degree of polymerization (DP) of 300 (cf. page 447, Table 15). It is said to be spinnable from an acetone solution, the viscosity of which at a concentration of 20 to 30% of cellulose-2.5-acetate and at a temperature of 45° to 55° .C is between 300 and 500 Pa.s (probably what is meant is: . . . between 30 and 50 Pa.s . . . ). Filaments obtained therewith have the following physical properties: Tensile strength (cN/dtex) 1.0 to 1.5, elongation (%) 25 to 30, density (g/cm$^3$) 1.33, melting point (°C.) 225 to 250, and, as already stated, a degree of polymerization of 300.

A summary of the prior art shows that in connection with acetone as solvent of a cellulose-2.5-acetate spinning solution a high degree of polymerization of 300 is stipulated with the result that the spinning solution has a low cellulose-2.5 acetate concentration of about 20 to 30%. With a starting material of this degree of polymerization, its concentration in acetone cannot be raised further for the production of a spinning solution because this would necessarily involve such a great increase of the viscosity of the spinning solution that the latter could no longer be spun with conventional spinning devices (for example at 40 to 50%). A substantially increased concentration would have the advantage that the acetone content in the spinning solution could be drastically reduced with the result of a considerable energy saving in the circulation and recovery of the acetone.

SUMMARY OF THE INVENTION

It is the object of the invention to provide filaments on the basis of a cellulose acetate soluble in acetone as well as a spinning solution especially suitable for the production of the filaments, which, eliminates the above described disadvantages of the prior art, in particular the deficient profitability, without impairing the properties of the filaments, in particular the tensile strength as well as the elongation, in comparison with the known products.

The above problem is solved by filaments on the basis of a cellulose acetate soluble in acetone, which is characterized in that the degree of polymerization (DP) of the cellulose acetate is between about 110 and 210. Especially preferred is the range of the degree of polymerization between about 150 and 180 and in particular between about 160 and 180.

In order to provide a cellulose acetate soluble in acetone, its degree of substitution (DS) is adjusted preferably between about 2.2 and 2.7. Especially preferred is a degree of substitution (DS) between about 2.4 and 2.6, more particularly between about 2.4 and 2.5.

Hereinbelow when a "cellulose-2.5-acetate" is mentioned, this term is to be understood in an abstract sense. This means that the degree of substitution of 2.5 can be exceeded in either direction more or less for as long as such a cellulose-2.5-acetate is soluble in acetone at room temperature (about 20° C.). In any event, the number "2.5" in the chemical designation "cellulose-2.5-acetate" is to include the cellulose acetates designated above with the preferred degree of substitution.

The titer of the filaments according to the invention is not critical. Preferably it is between about 1 and 14 dtex, in particular between about 1.5 and 9 dtex. This is a fineness designation for filaments, i.e. a weight per length, the unit of which is dtex.

Preferably, the parameters of the filaments according to the invention are adjusted so that their tensile strength is between about 0.9 and 1.2 cN/dtex, in particular between about 1.0 and 1.2 cN/dtex, and the elongation between about 10 and 30%d, in particular between about 15 and 25%. Thus they meet the requirements stipulated for the known filaments of this kind to make them suitable for the areas of application indicated hereinbelow.

It has been found that the cellulose-2.5-acetates soluble in acetone and forming the essence of the invention are suitable to be converted into an optically isotropic spinning solution for the production of filaments which contains this cellulose-2.5-acetate dissolved in acetone and possibly other additives. According to the invention, this optically isotropic spinning solution is characterized in that the concentration of the cellulose-2.5-acetate in the spinning solution is about 35 to 47 mass-% and the degree of polymerization (DP) of the cellulose-2.5-acetate between about 110 and 210. Preferably the cellulose-2.5-acetate has the degrees of polymerization and substitution already named above in connection with the description of the filaments.

For optimum concentration of the cellulose-2.5-acetate in the optically isotropic spinning solution of the invention it is of special advantage if the concentration (c) in the spinning solution is at most 8 mass-% and in particular at most 6 mass-% below the critical concentration (c*) at room temperature (about 20° C). If this critical cellulose-2.5-acetate concentration is exceeded ($c>c^*$) to higher concentrations of the spinning solution without the action of external forces, such as shearing forces, the spinning solution is brought from the isotropic to the anisotropic state.

Further, in order to improve the optically isotropic spinning solution of the invention, various additives may be incorporated in it, such as pigments and water. Preferably the optically isotropic spinning solution of the invention contains up to about 6 mass-% and in particular about 2 to 4 mass-% water. Incorporation of water has the advantage that the viscosity of the spinning solution is reduced, resulting in improved spinnability.

When the optically isotropic spinning solution of the invention is employed for the production of filaments which are used for a (cigarette) filter tow to make cigarette filters, the spinning solution preferably contains a finely divided pigment, in particular a white pigment, such as preferably titanium dioxide. The particle size is appropriately in the range from about 0.3/μm to 0.5/μm. The amount of particulate pigment in the spinning solution is 0.1 to 0.8%, preferably about 0.4 to 0.8 mass-%, referred to the cellulose-2.5-acetate content of the spinning solution. Especially preferred is the mass-percentual range of about 0.4 to 0.6.

The advantages attainable with the invention may be described as follows: In the spinning apparatus, an optically isotropic acetone spinning solution with a substantially higher content of cellulose-2.5-acetate can be produced and spun, in particular by the conventional dry spinning method. When producing e.g. (cigarette) filter tow, due to the high spinning solution concentration very much less acetone per weight unit of produced filter tow need be recovered than under previous conditions. In this manner, the costs connected with the recovery of the acetone can be appreciably reduced at e.g. equal filter tow production. Thus, with the spinning solution of the invention a spinning solution of very much higher concentration than previously can be produced and processed, at equal viscosity.

The above mentioned advantages are therefore obtained with an optically isotropic acetone spinning solution of high cellulose-2.5-acetate concentration. The anisotropism or isotropism can be ascertained visually. An anisotropic phase looks cloudy and/or "nacreous", while the isotropic phase is always clear. Also the particular isotropic or anisotropic state of a spinning solution can be ascertained microscopically with crossed nicols. When observing between nicols for example a sample of an anisotropic spinning solution between the slide and cover glass of a microscope after pressing down the cover glass, at least a part of the solution is transparent. Also, the temperature plays a role in this respect; when the temperature of an anisotropic cellulose acetate solution is raised from an initially room temperature, the anisotropic phase can gradually change to the isotropic phase. If the temperature is increased further, the entire spinning solution becomes an isotropic system. The temperature ranges at which these transitions take place vary depending on the type of cellulose derivative, its concentration in the spinning solution, and its degree of substitution.

The possible use of the filaments obtained according to the invention are not limited in comparison with the known filaments of this kind. Thus they can be used for the production of filter tow (filament bundles gathered to a ribbon), for tobacco smoke filters, in particular cigarette filters, but also for example for the production of—textile—yarns for lining materials or of blends with cotton.

Technologically the present invention could be explained as follows: The starting point is an isotropic acetone solution of cellulose-2.5-acetate of the designated type, the concentration of which can be raised to close to the critical concentration value (c*), from which an anisotropic phase forms. When such an isotropic solution is introduced into the spinnerettes (capillaries), the shearing forces in the orifice occurring due to the flow forces cause predominantly an orientation and hence anisotropism occurs. In the region of the capillary and after exiting from the capillary, the isotropic phase does not differ from a true anisotropic phase. For this reason one obtains in both cases almost identical fiber strengths. When the spinning solution leaves the spinnerette, two processes compete, on the one hand the relaxation of the oriented polymer chains, and on the other hand the evaporation of the acetone. Due to the high concentration, which is only slightly below the aforementioned critical concentration (c*), the relaxation time of the oriented polymer chains is longer than the time within which by evaporation of the acetone the critical concentration (c*) is reached. In other words, the evaporation rate is higher than the relaxation rate. The anisotropic state sets in for example at a concentration of the cellulose-2.5-acetate of about 47 to 48 mass-% in the acetone solution when its DP value is about 150 and its DS value about 2.45. This statement is only by way of example. By as rapid as possible evaporation, therefore, the acetone spinning solution of the cellulose-2.5-acetate is to be brought into a concentration range in which the system shows anisotropism. It is therefore surprising that according to the invention an isotropic spinning solution can be employed and with it filaments, which until now could be produced only with anisotropic spinning solutions, can be obtained in a most profitable manner.

The invention will be illustrated hereinbelow still more specifically with reference to two examples:

EXAMPLE 1

A spinning solution of the following composition was used:

| | Mass-% |
|---|---|
| Cellulose acetate (DP: 150, DS: 2.45) | 43.2 |
| Water | 3 |
| Acetone | 53.8 |

The spinning solution was spun in a conventional dry spinning installation having a die-plate with 125 orifices. The orifices had a triangular cross section. The triangle had a side length of 45/μm. The die temperature was 47° C. and the die pressure 88 bars. The spinning rate was 340 m/min at a stretch factor of 1.6. In the spinning shaft of a total length of 4 m present below the spinnerette, a temperature of 70° C. prevailed. Per hour 20 $m^3$ acetone-air mixture were pumped off. The filaments obtained had the following physical properties:

Titer: 3.1 dtex
Tensile strength: 1.0 cN/dtex
Elongation: 19.4%

The 125 filaments obtained with the method according to this example were combined to a filament bundle. Eighty such filament bundles were gathered to a cigarette filter tow.

EXAMPLE 2

A spinning solution of the following composition was employed:

| | Mass-% |
|---|---|
| Cellulose acetate (DP: 170, DS: 2.47) | 41.1 |
| Water | 3 |
| Acetone | 54.9 |

The spinning solution was spun on the same dry spinning installation as in Example 1, but the die-plate had 240 orifices. The orifices had a triangular cross section. The triangle had a side length of 45/μm. The die temperature was adjusted to 52° C., and the die pressure was 80 bars. The spinning rate was 310 m/min at a stretch factor of 1.3. The temperature in the spinning shaft of a total length of 4 m present under the spinnerette was 70° C. Per hour, 10 $m^3$ acetone-air mixture was pumped off. The filaments obtained had the following physical properties:

Titer: 3.6 dtex
Tensile strength: 1.1 cN/dtex
Elongation: 20.5%

What is claimed:

1. Filaments comprising a cellulose acetate soluble in acetone, said cellulose acetate having a degree of polymerization (DP) between 110 and 210, a degree of substitution (DS) between 2.2 and 2.7 and wherein each of said filaments has a titer between 1 and 14 dtex, a tensile strength between 0.9 and 1.2 cN/dtex and an elongation between 10 and 30%.

2. The filaments according to claim 1 wherein the degre of polymerization is between 160 and 180.

3. The filaments according to claim 1 wherein the degree of substitution is between 2.4 and 2.5.

4. The filaments according to claim 1 wherein said titer is between 1.5 and 9 dtex.

5. The filaments according to claim 1 which additionally contain a finely divided pigment in an amount of 0.1 to 0.8 mass-%.

* * * * *